US005706837A

United States Patent [19]

Iwata

[11] Patent Number: 5,706,837

[45] Date of Patent: Jan. 13, 1998

[54] HAIR BUNDLING CORE AND METHOD OF USING THE CORE

[76] Inventor: Hidenobu Iwata, 3-1, Fuchinobe Honmachi 5-chome, Sagamihara-city, Kanagawa, Japan

[21] Appl. No.: 550,399

[22] Filed: Oct. 30, 1995

[30] Foreign Application Priority Data

Jul. 27, 1994 [JP] Japan ..... 6-196035

[51] Int. Cl.[6] ..... A45D 24/00

[52] U.S. Cl. ..... 132/200; 132/212; 132/54; 132/242

[58] Field of Search ..... 132/54, 55, 56, 132/200, 201, 212, 222, 223, 224, 246, 242, 248, 249, 250, 251

[56] References Cited

U.S. PATENT DOCUMENTS

| | | | |
|---|---|---|---|
| 2,754,832 | 7/1956 | Garland | 132/246 |
| 2,765,798 | 10/1956 | Carvell | 132/55 |
| 2,941,534 | 6/1960 | Otto et al. | 132/251 |
| 3,078,855 | 2/1963 | Lovret | 132/246 |
| 3,092,118 | 6/1963 | Otto et al. | 132/251 |
| 3,108,604 | 10/1963 | Krull | 132/250 |
| 3,126,017 | 3/1964 | Sidelman | 132/212 |
| 3,216,427 | 11/1965 | Jefferson | 132/251 |
| 3,662,767 | 5/1972 | Murtha | 132/212 |
| 4,201,236 | 5/1980 | Morefield | 132/250 |
| 4,911,186 | 3/1990 | Hayden | 132/246 |

*Primary Examiner*—Gene Mancene
*Assistant Examiner*—Pedro Philogene
*Attorney, Agent, or Firm*—Oliff & Berridge, P.L.C.

[57] ABSTRACT

A hair bundling core structure comprising an elastic cylinder made of a foamed synthetic resin having a thickness and a strength which are sufficient for facilitating the insertion and extraction of a hair setting U-shaped pin and are capable of fixing the hair by the insertion. The core structure is cut from one end face to the other thereof to have a rift.

1 Claim, 12 Drawing Sheets

HAIR BUNDLING CORE AND METHOD OF USING THE CORE

BACKGROUND OF THE INVENTION

1. Field of the Invention

The present invention relates to a hair bundling core to be used for setting the hair, and a method of using the core.

2. Related Art

For dressing the hair into an erected, or set-up style, it is important to make the whole of the hair bulky. For this purpose, it is an ordinary practice to comb the hair backward, or to insert artificial hairs for combing, which is made of chemical fiber, into the original hair. However, the use of the back-combed hair or the artificial hairs for combing will require technically high skills, and also the back-combing itself will damage the hair according to its literal sense.

In another prior art method, an annular member which is made of such artificial hairs beforehand, or a plurality of the vertically stacked annular members are set in the head for increasing the height of the hair style, in stead of inserting the artificial hairs into the head. In this case, a portion of the hair is formed into a hair bundle and inserted into the hole of the annular member. After this, the annular member is fixed to the root of the hair bundle, and then the hair is set on the surface of the annular member by pins. However, it is troublesome to thread the annular member with the hair bundle by inserting the leading end thereof into the hole of the annular member. And also, the hair style made by the annular member is apt to be broken, since the annular member does not provide a sufficient fixing force as the hair setting base when the hair is fixed thereto by the pin. The considerable skills and cautions are also required for the use of the annular member. One of the reason is that there is a disadvantage that the bristles of a brush may be caught at the annular member upon brushing the hair set on the surface of the annular member. Moreover, a wide variation of the hair style cannot be achieved by the use of the annular member.

SUMMARY OF THE INVENTION

It is, therefore, a first object of the present invention to propose a light and simple core structure by which the hair can be set up conveniently and rapidly, without using the combed-back, or artificial hairs and the annular member. In order to achieve this object, according to the present invention, there is provided a hair bundling core structure comprising an elastic cylinder made of a foamed synthetic resin having a thickness and strength which are sufficient for facilitating the insertion of a hair setting U-shaped pin into and an extraction thereof from the elastic cylinder and are capable of fixing the hair by the insertion of the U-shaped pin. The elastic cylinder may preferably be cut from its one end surface to the other end surface thereof to have a rift. The core structure made of a foamed synthetic resin prevents the set of hairs from been heavy and can be manufactured at a favorably low cost. The core structure also facilitates the fixation of the hair thereto by the pin to make the hair setting easy. In the above mentioned construction, the rift can be omitted from the core structure as commercial goods such that the user may cut the core to form the rift of a desired shape at one's choice.

A second object of the present invention is to enable an expert such as a beauty artist to freely prepare the height, external diameter and shape of the core structure necessary for various hair styles by cutting the cylinder or by combining two or more cylinders. In order to achieve this object, the core structure is preferably made of the foamed synthetic resin which can be easily cut and elastically deformed. The cylinder may preferably be a circular cylinder having a constant external diameter and a constant thickness entirely of its length, such that it is useful to cut one cylinder into several short cylinders to be doubly-fitted or jointed each other, for example. This guarantees a wide variety of hair style using a single cylinder.

A third object of the present invention is to provide a core structure, which can allow the ordinary user other than the expert to make a bulky hair style without any special skills. In order to achieve this object, the cylinder of the core structure may be preferably formed into a divergent shape, with a peripheral wall expanding outwardly towards its lower end.

A fourth object of the present invention is to propose a method of setting the hair easily and reliably by using the core structure described above. In order to achieve this object, the method comprises: the first step of setting the hairs in the preset range of a head into a first hair bundle having a root portion which is defined by a mass of root neighboring portions of the hairs, and binding the lower end of the first hair bundle in the root portion at the center of said preset range near the roots of the hairs, and then pinching the root portion at two sides of said center of the preset range with a pair of hairpins; the second step of opening said rift to form a gap and inserting the lower portion of the root-bound, first hair bundle into the hole of the elastic cylinder through the gap, and then pushing said core structure at its lower face onto the outer face of the head within the preset range; and the third step of fixing the core structure on the head with the U-shaped pin having a pair of legs, by inserting one of the legs between the hairpins and a head skin, while the core structure being pushed, and by piercing the other leg into the lower portion of the core. According to this method, the core structure can be easily threaded with the first hair bundle by inserting it into the core through the gap. The core is free from unstableness with respect to the head, since it is fixed by the U-shaped pin to the hairpins which are also fixed to the root portion. As the result, the core may be a hair setting base fixed to the head firmly, ensuring an easy and reliable setting of the hair style with little breakage thereof.

The other objects and features of the present invention will become apparent from the following description with reference to accompanying drawings.

BRIEF DESCRIPTION OF THE DRAWINGS

FIG. 17A schematically shows the mounted state in the second embodiment, while

DESCRIPTION OF THE PREFERRED EMBODIMENTS

Figure 1:
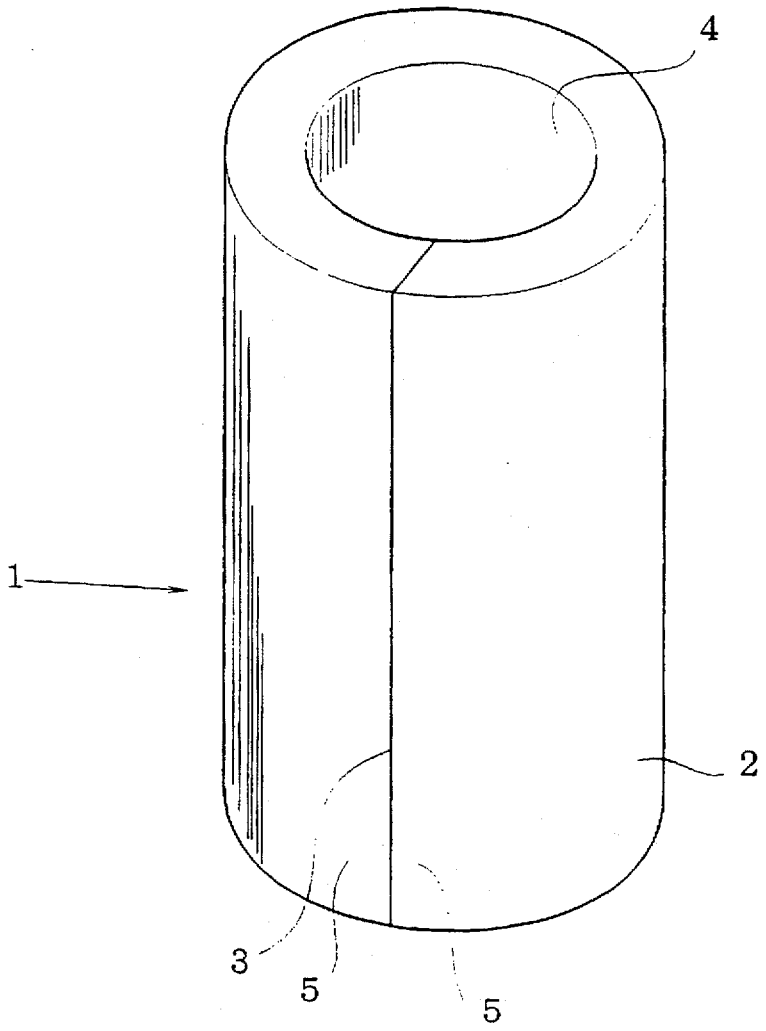
FIG. 1 is a perspective view showing a hair bundling core according to a first embodiment of the present invention.
Figure 2:
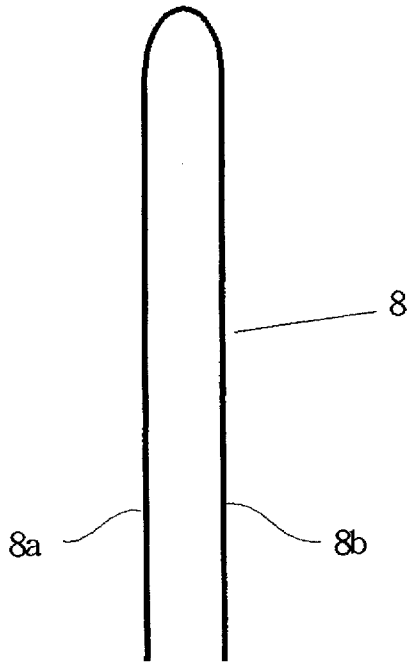
FIG. 2 is a side elevation of a U-shaped pin.
Figure 3:
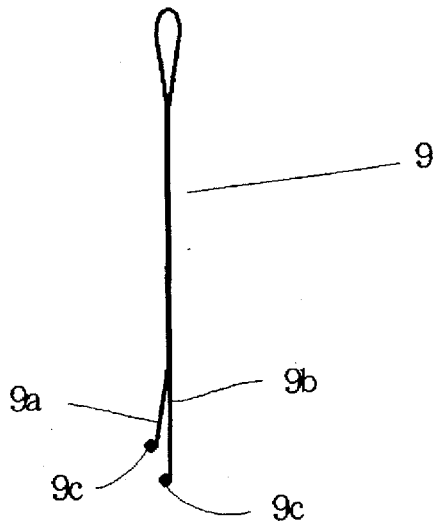
FIG. 3 is a side elevation of a hairpin.

A first embodiment of the present invention is shown in FIGS. 1 to 15.

Reference numeral 1 designates a hair bundling core according to the present invention. This core 1 has an elastic cylinder 2 made of a foamed synthetic resin, such as polystyrene foam or urethane foam. The core has such a thickness and a strength which are sufficient for facilitating an insertion and extraction of a hair setting U-shaped pin 8, and are capable of fixing the hair by the insertion of the U-shaped pin thereto. The cylinder 2 has a peripheral wall which is cut from its one end face to the other end face to form a rift 8, which separates two side portions 5 and 5 thereof. Due to the above-specified thickness and strength, the core prevents the hair fixing U-shaped pin from coming out therefrom, when it is used as the hair setting base. Therefore, the hair style set by the core neither deforms nor gets out of its shape by a slight force, unlike the back-combed hair or the style made by the artificial hairs.

The cylinder 2 has a hole 4, defined by an inside of the peripheral wall, for letting a later-described first hair bundle pass therethrough. The cylinder has such an elasticity that the rift 3 can be opened against the elasticity with the fingers of the user against the elasticity to form a gap 3A, through which the lower portion of the first hair bundle can be inserted into the hole 4. In this embodiment, the cylinder 2 is a circular cylinder having a constant external diameter and a constant thickness entirely of its length. However, the cylinder may be a divergent cylinder or a polygonal cylinder, as will be described in the other embodiments.

The length, external diameter, and thickness of the cylinder 2 may vary within the spirit and purpose of the prevent invention. A preferable example of the cylinder 2 is sized, as commercial goods, to have a length of about 7 cm, an external diameter of about 5 cm and a thickness of about 1 cm. For use, the cylinder 2 may be cut at a suitable length according to the size of the hair bundle to be set, or adjusted to a suitable diameter by a later-described method. Alternatively, a plurality of cylinders may be combined.

A primary usage of the core of the embodiment is shown in FIGS. 4 to 13.

Figure 4:
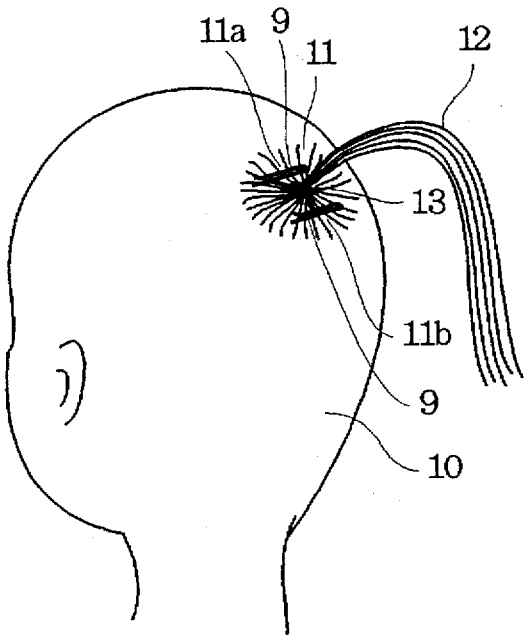
FIG. 4 is an explanatory view showing a state in which preparations are completed for mounting the hair bundling core of the first embodiment.

First of all, as shown in FIG. 4, the hairs of a preset range 11 of a head 10 are set into a first hair bundle 12, which has a root portion defined by a mass of root-neighboring portions of the hairs. The lower end of the first hair bundle is bound by a first bind 13 of a rubber string in the root portion near the hair roots at the center of the preset range 11. The root portion is clamped by a pair of hairpins 9 and 9 at two sides 11*a*, 11*b* of the center of the preset range, which are opposed to each other longitudinally or transversely of the preset range. The hairpin may be a bell-shaped pin shown in FIG. 3, or a so-called "American" pin. The bell-shaped pin has a pair of legs 9*a* and 9*b* provided with balls 9*c* at their ends. The American pin only differs from the bell-shaped pin in that it has no balls. When clamping the root portion, it is desirable to let the hairpins pinch as much hairs as they can at the portions as close to the root of the hairs as possible so as to prevent the vertical movement of the hairpins, since these hairpins function to anchor the core 1.

Figure 5A:
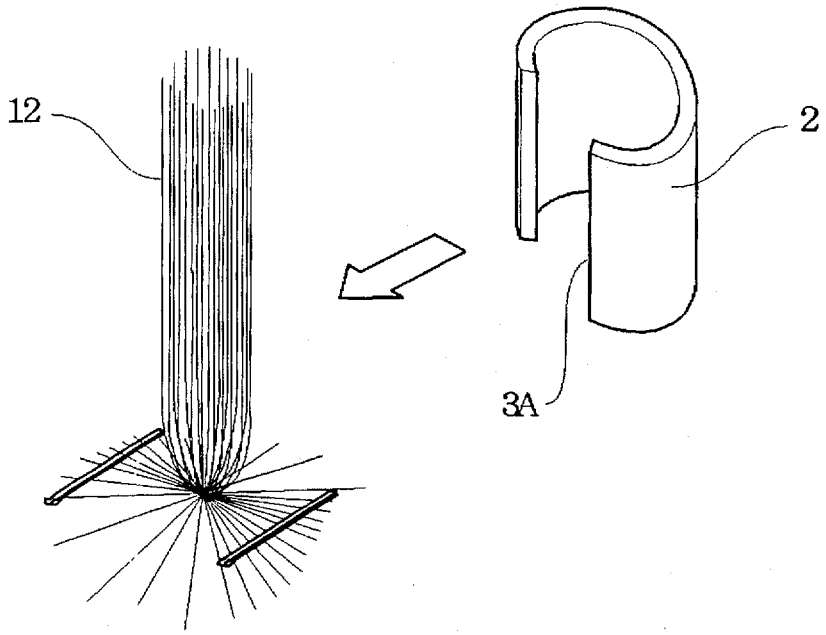
FIG. 5A is an explanatory view showing a process for inserting the first hair bundle into the hole of the core in the embodiment.
Figure 5B:
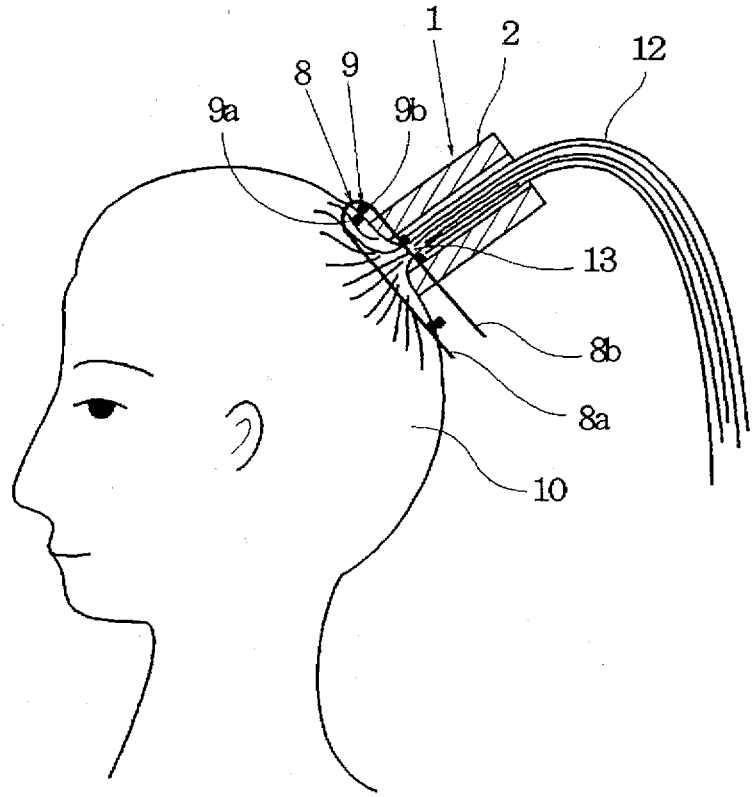
FIG. 5B shows a state in which the mounting of the core is completed.

Next, as shown in FIG. 5A, the rift 3 is opened to form the gap 3A, through which the lower portion of the first hair bundle 12 is inserted into the hole 4. The core 1 is then pushed at its lower face onto the outer face of the preset range 11 of the head 10. In thus pushed state, the core 1 is fixed on the head 10 by the U-shaped pin 8 having a pair of legs 8*a* and 8*b* by inserting one leg between the hairpins 9 and 9 and the head skin as shown in FIG. 5B, and piercing the other leg into the lower portion of the core 1.

Figure 6:
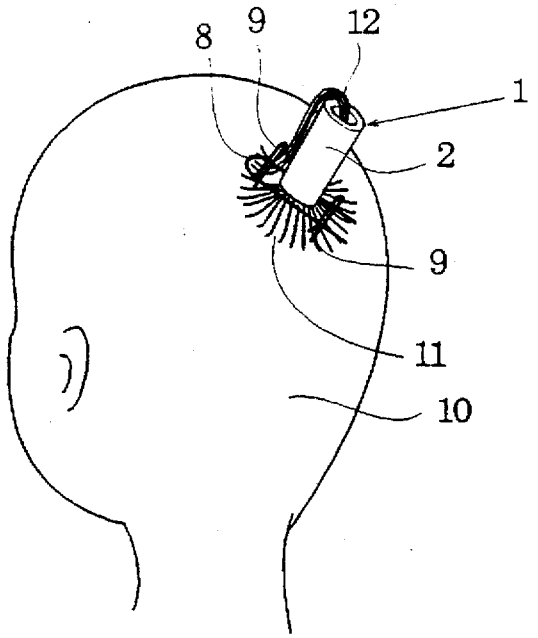
FIG. 6 is an explanatory view showing one of the methods of treating the hair bundle inserted into the hole after the core of the embodiment is mounted.
Figure 7:
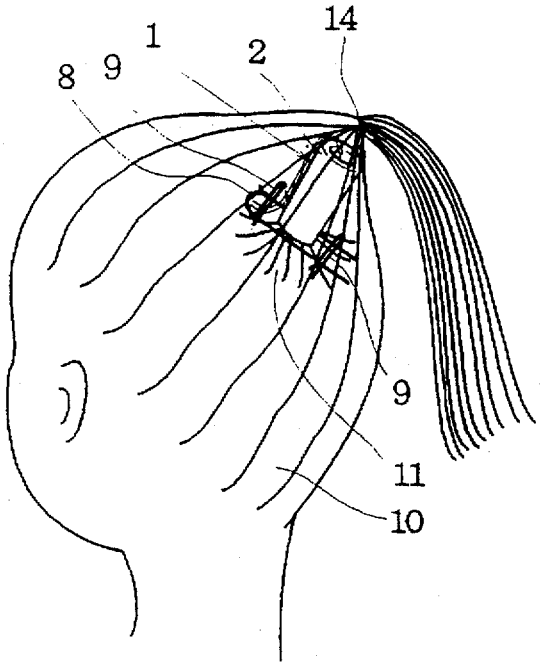
FIG. 7 is an explanatory view showing one of the methods of treating the other hairs which are not inserted into the hole, from the state of FIG. 6.
Figure 8:
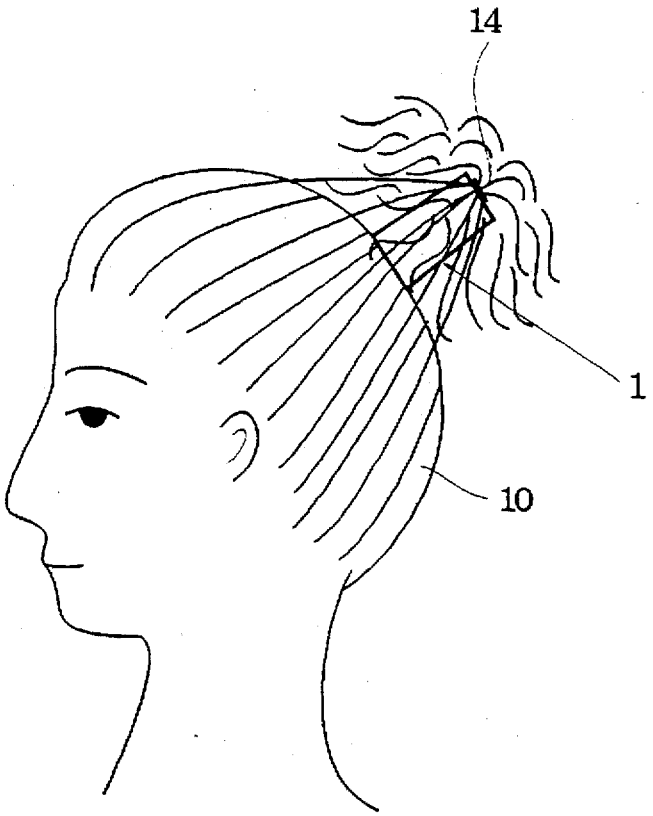
FIG. 8 is an explanatory view showing the state in which the hair is set from the state of FIG. 7.
Figure 9:
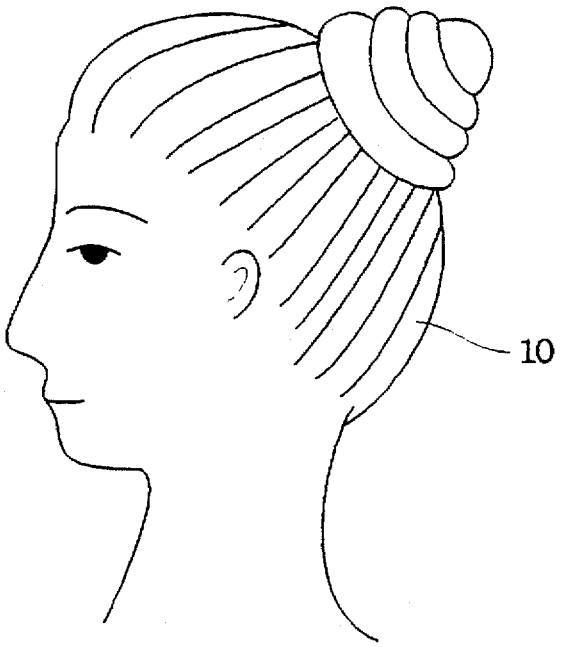
FIG. 9 is a perspective view showing a state in which the hair is set to a style different from that of FIG. 8 by either the method of FIGS. 6 and 7 or another method.
Figure 10:
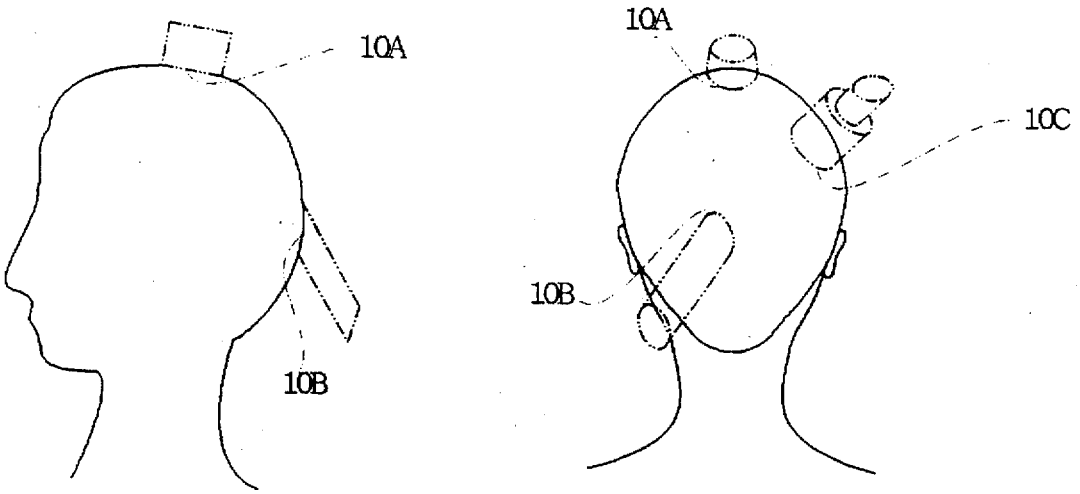
FIG. 10 is a view showing several examples of placing the core.

After the fixing of the core 1, the hair can be set freely by using the core as the base. FIG. 6 shows one example of hair setting. In this method, the first hair bundle 12 has an upper portion which is protruding from the top of the core 1 and turned back along the outside of the same, while the leading portion of the first hair bundle being pinched to the root portion thereof by the hairpin 9. After that, circumferential hairs other than the first hair bundle 12 may be wholly or partially collected above the core 1, passing the outside of the core 1, as shown in FIG. 7, and bound with a second binding 14 of a rubber string or the like. The upper portion of the circumferential hairs above the second binding 14 may either be curled for setting it as shown in FIG. 8, or be wound round the outside of the core 1 and fixed by the U-shaped pin 8, for example, as shown in FIG. 9. In the case of FIG. 9, the turn-back or the second binding 14 can be omitted. In this way, the hair style can be made by the circumferential hairs on the head surface, after mounting the core. For this styling, the circumferential hairs can be irregularly collected in various directions on the core and fixed by the U-shaped pin instead of binding by the rubber string. In this case, the hair style can be reliably prevented from getting out of shape, if mousse or a gel setting agent is used. Of course, the circumferential hair can be freely set in another way using the core 1. Moreover, the core can be fixed at a suitable place such as on the top 10A, the back 10B, or the side 10C of the head, as shown in FIG. 10.

Figure 11A:
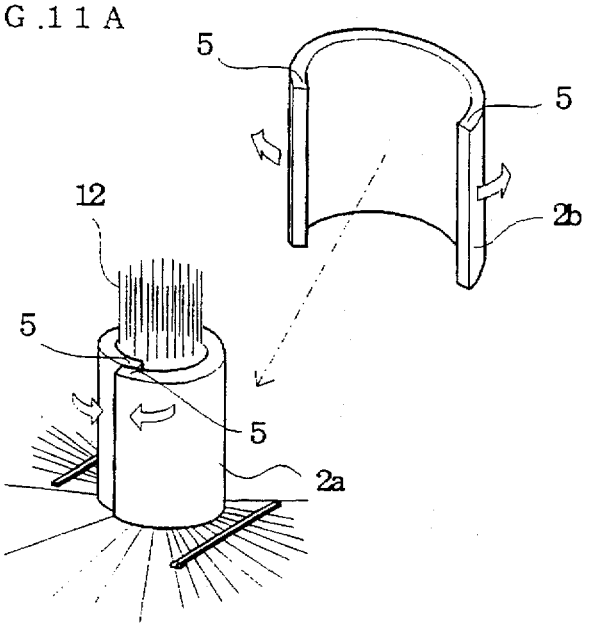
FIG. 11A shows a process for doubly fitting two cylinders of the embodiment.
Figure 11B:
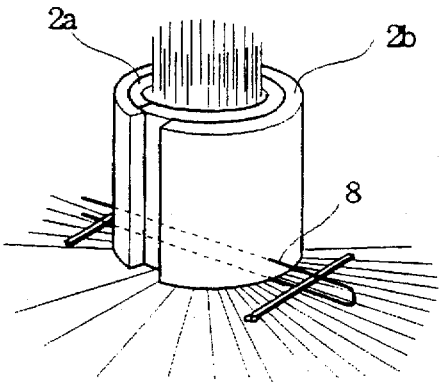
FIG. 11B shows a doubly-fitted state thereof.
Figure 12:
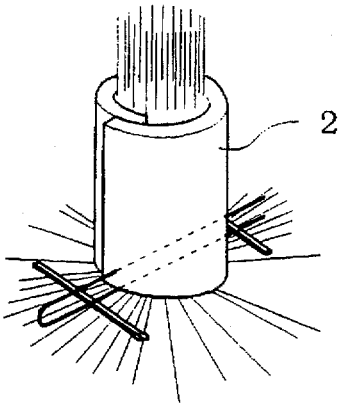
FIG. 12 shows the cylinder of the embodiment used in a diminished state.

When the user needs a cylinder radially larger and thicker than the prepared one, it is convenient way to combine two cylinders 2*a* and 2*b* of the same length, as shown in FIG. 11. In this method, the first cylinder 2*a* is threaded with the lower portion of the first hair bundle 12 as explained previously, and then either one of the two side portions 5 and 5 of the rift 3 is pushed into the inside of the other, as indicated by arrows in FIG. 11A. After that, the first cylinder can be diminished to have a smaller external diameter by compressing the same by the hand of user. The second cylinder 2*b* is then extended by pulling its side portions 5 and 5 in the directions of arrows shown in FIG. 11A and fitted around the first cylinder 2*a*, thereby fixing the doubly fitted cylinders by piercing them with the U-shaped pin 8 as shown in FIG. 11B. If a radially smaller cylinder is to be used, on the contrary, it can be achieved only by diminishing the cylinder and piercing the U-shaped pin into the two side portions 5 and 5 superposed to each other, as shown in FIG. 12.

Figure 13A:
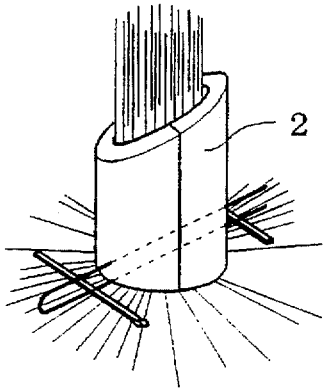
FIGS. 13A to 13C are explanatory views for cutting the cylinder of the embodiment for use, each showing an obliquely-cut cylinder, a cylinder with a chamfered end, or two jointed cylinders one of which has obliquely-cut ends.
Figure 13B:
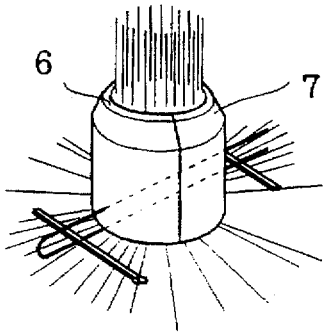
Figure 13C:
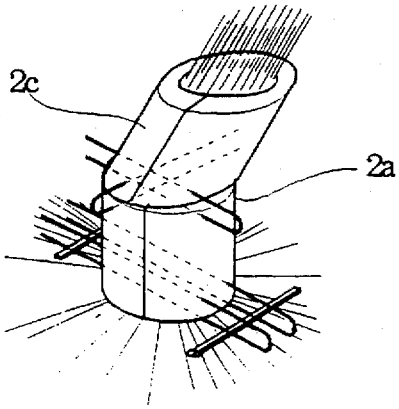

The core 1 may preferably made of a material capable of cutting by scissors or a cutter, such that the core may be cut into various shapes. Due to this, the cylinder may, for example, be obliquely cut at its upper portion, as shown in FIG. 13A, or have a chamfer 7 at its outer circumference of its top end 6 as shown in FIG. 13B. By chamfering the outer corner of the top end, it is possible to prevent the circumferential hairs set on the cylinder 2 as shown in FIG. 8 from protruding outward at the place where the hairs touch the corner. This chamfering is advantageous in hair styling for a person with thin hair. For giving another variation to the hair style, the user may cut two ends of the cylinder 2*c* obliquely and joint it to another cylinder 2*a* by the U-shaped pin, as shown in FIG. 13C. There would be many other modes of cutting and combinations in accordance with the hair style to be made, for example a combination of the shorter and longer cylinders, or a combination of an vertically-cut half cylinder and another cylinder.

Figure 14:
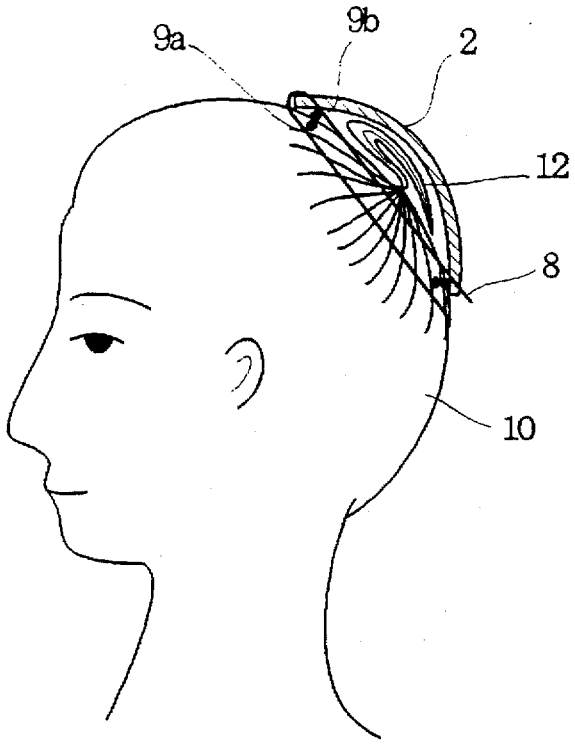
FIG. 14 is an explanatory view showing the cylinder of the embodiment which is used without threading with the first hair bundle.
Figure 15:
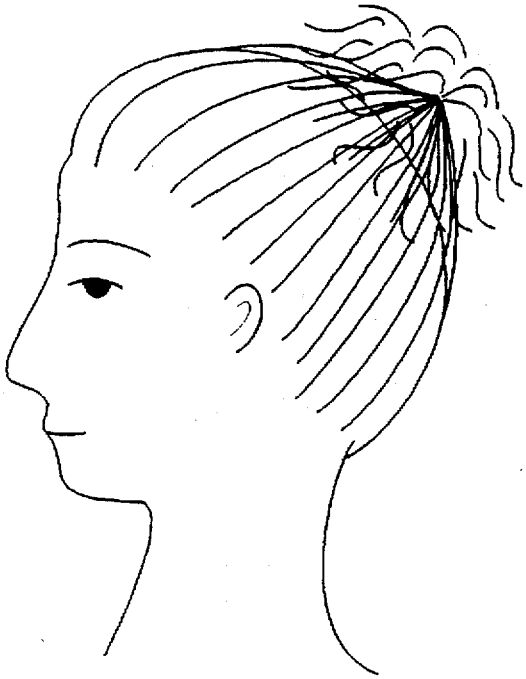
FIG. 15 is an explanatory view showing an example of a hair style set by the usage of the cylinder shown in FIG. 14.

FIGS. 14 and 15 show another usage of the core according to the first embodiment.

In this usage, the cylinder 2 is deformed into a generally plate-shaped member by widely expanding the rift 3 against its elasticity. The plate-shaped member is put on the root portion of the first hair bundle 12 and around its neighborhood as shown in FIG. 14, and then fixed to the hairpin 9 clamping the root portion by means of the U-shaped pin 9 as previously discussed in the FIG. 5B. Either the whole of the first hair bundle 12 as shown or only the root-neighboring part of the same may be housed between the plate-shaped member and the head, while the part of the first hair bundle other than the root-neighboring part being depending from the plate-shaped member in the latter case. After this, the hair style can be made freely using the plate-shaped member deformed from its original shape as a base for setting as shown in FIG. 15. This usage is suitable for making a hair style which is bulking smoothly in a relatively wide range of the head.

Figure 16A:
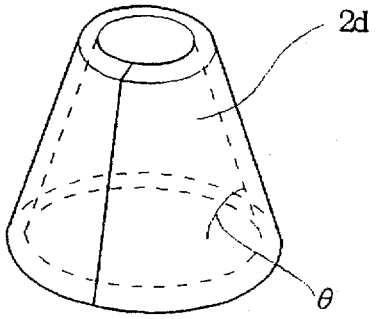
FIG. 16A is a perspective view showing a hair bundling core of a second embodiment of this invention.
Figure 16B:
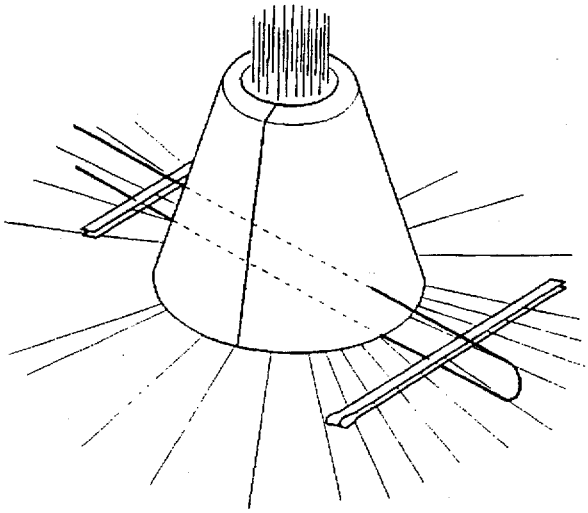
FIG. 16B shows a mounted state thereof.

A second embodiment of this invention is shown in FIGS. 16 and 17.

The cylinder 2*d* according to this embodiment has a peripheral wall expanding outwardly towards its lower end, such that the cylinder is formed into a divergent shape. Excepting this feature, the core is the same to the core according the first embodiment. The term "divergent" is used to include a cylinder which is shaped into a frustum or a head-cut hollow cone as shown in the drawings, or a cylinder which is formed into a head-cut dome. In the frustum-shaped cylinder, a declination angle θ of its peripheral wall, which is formed between a horizontal surface defined by the lower end of the cylinder and a generatrix of the frustum, may differ in accordance with the degree of bulging of the hair style to be made. FIGS. 16 and 17 show the frustum-shaped cylinder having the declination angle larger than 45 degrees, which is relatively similar to the cylinder of the constant diameter. However, the cylinder according to this embodiment may be the cylinder having the declination angle less than 45 degrees with its peripheral wall expanding wide outwardly towards its lower end.

Figure 17A:
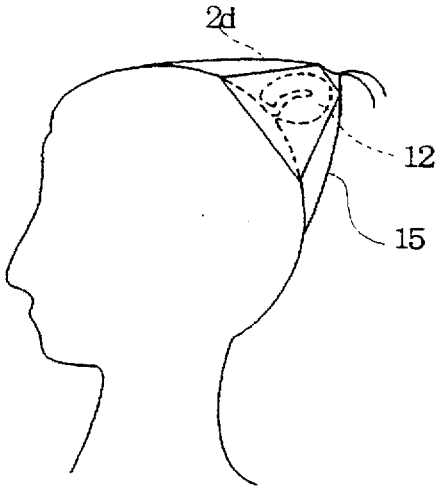
Figure 17B:
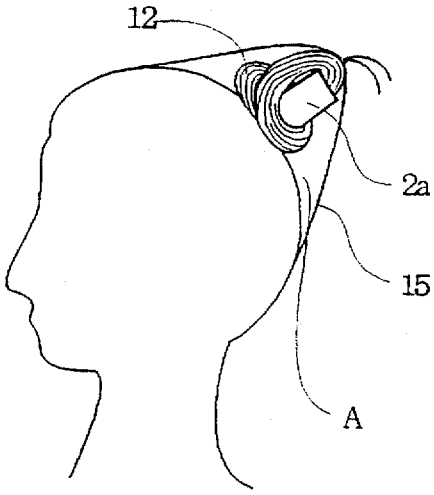
FIG. 17B shows the corresponding state in the first embodiment.

As compared with the first embodiment, the divergent cylinder 2*d* facilitates forming a bulky hair style for the reason stated herebelow. When a hair style is made by binding the circumferential hairs 15 around the core other than the first hair bundle at the second binding above the cylinder, as shown in FIGS. 17A and 17B, a space (A) is left between the cylinder and the circumferential hairs if the cylinder 2*a* of the first embodiment is used. Therefore, it is necessary to fill up the space by turning back the first hair bundle 12 from the top of the cylinder 2*a* and winding it around the lower portion of the cylinder as shown in FIG. 17B, or by inserting the artificial hairs into the space. However, in a case that the divergent cylinder 2*d* is used, those troublesome works are not needed because that space is hardly formed, so that the divergent cylinder can be easily handled for ordinary users. Moreover, the first hair bundle may be confined wholly in the cylinder 2*d* as shown in FIG. 17A or depending from the cylinder in accordance with the desired hair style.

In the present embodiment, it is desirable to prepare several kinds of cylinders 2*d* which are different in the height, the lowerend diameter, and the declination angle of the peripheral wall. It is also possible to change the height of the divergent cylinder by cutting it as it is in the cylinder of the first embodiment, however it is more convenient for ordinary user to selectively use several kinds of cylinders prepared in advance.

A third embodiment of the present invention is shown in FIGS. 18 and 19.

Figure 18A:
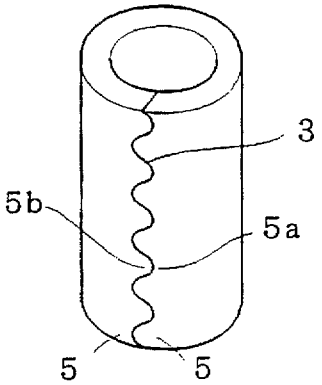
FIGS. 18A to 18C are perspective views of hair bundling cores according to a third embodiment of the present invention, each showing the core having an undulated rift, the core having a zigzag rift, the core having a rift of a broken line other than zigzag line.
Figure 18B:
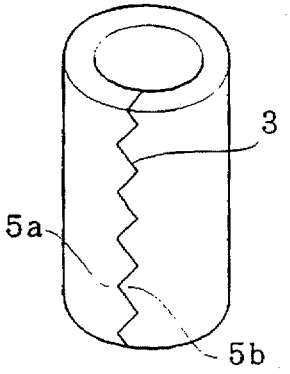
Figure 18C:
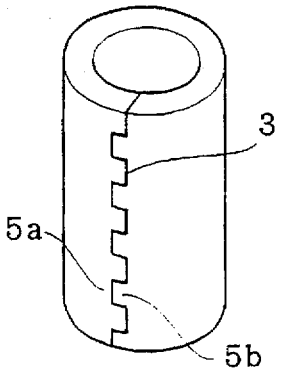

The cylinder 2 according to this embodiment has a pair of side portions 5 and 5 separated by the rift 3, while each side portion having a plurality of recessions 5*a* and projections 5*b* for providing mutual engagement with the projections and recessions of the other side portion. By making these recessions and projections, the rift 3 may be formed into an undulated line as shown in FIG. 18A, or a zigzag line as shown in FIG. 18B, or a broken line other than the zigzag line as shown in FIG. 18C, each extending from one end surface to the other end surface of the peripheral wall.

Except the configuration of the rift, the cylinder of this embodiment is the same to those in the first or second embodiments. Especially, the general shape of the cylinder in this embodiment may be a divergent shape shown in the second embodiment, not limited to the shape of the one in first embodiment.

Figure 19A:
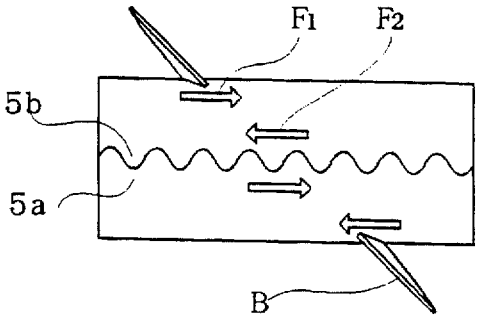
FIG. 19A is an explanatory view showing a state that the cylinder of the third embodiment is cut by scissors.

A first function of the recessions 5*a* and projections 5*b* is to prevent the slide of one of the side portions with respect to the other by engaging mutually. When the cylinder is obliquely cut to apply its cut surface to the back surface of the head as shown in FIG. 10, side portions 5 and 5 may slide each other in its axial direction with the cylinder being deformed due to the shearing force of the scissors or cutter. The slide makes a cut surface uneven when the cylinder elastically restores to its original shape, resulting in unstableness of the cylinder. However, in the cylinder according to this embodiment, the recessions and projections prevent such slide by countering the shearing force $F_1$, $F_1$ of the scissors (B) with the engagement force $F_2$, $F_2$ of the recessions and projections as shown in FIG. 19A, such that the above-mentioned unstableness is certainly prevented.

Figure 19B:
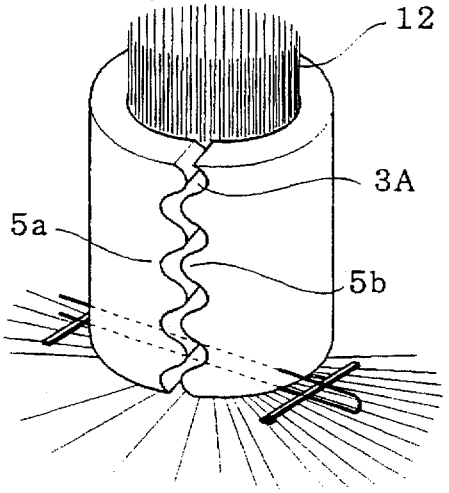
FIG. 19B is an explanatory view showing a state that the cylinder is threaded with the first hair bundle.

A second function of the recessions 5*a* and projections 5*b* is to prevent the the hairs from swelling out from the rift 3 as a hair stopper. For example, when the first hair bundle 12 is thicker than the hole 4 of the cylinder, the part of the first hair bundle 12 may swell out from the rift 3, which is not closed completely. In the third embodiment, however, such inconvenience does not happen since the recessions and projections function as the hair stopper when the gap is slightly opened as shown in FIG. 19B.

A fourth embodiment of the present invention is shown in FIG. 20.

Figure 20A:
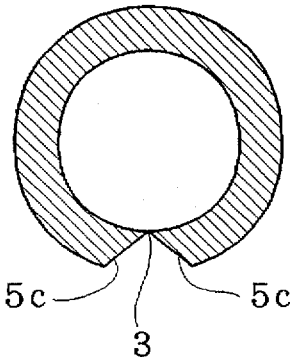
FIG. 20A is a cross sectional view of the core structure according to a fourth embodiment of this invention.
Figure 20B:
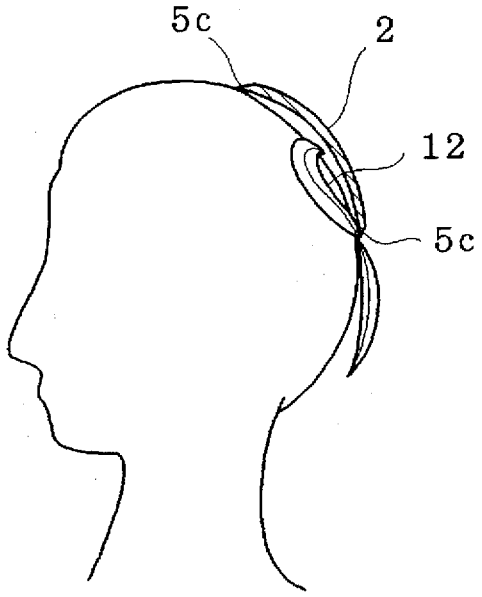
FIG. 20B shows a state of use thereof.

The core according to this embodiment has has a pair of side portions 5 and 5 separated by the rift 3, while each side portion has an outer edge 5*c* and 5*c* chamfered to form an indentation as shown in FIG. 20A. The cylinder of this type is particularly suitable for the usage of the core explained in FIGS. 14 and 15. In the cylinder according to the first embodiment without such chamfered side portions, a step is formed between each side portion and the head skin as shown in FIG. 14. Since the step deteriorates an aesthetic appearance of the hair style to be made, it would be necessary to fill a space formed between the hair and the head skin due to the step. In the cylinder according to this embodiment, on the contrary, the step is substantially removed by the chamfered edges 5*c* and 5*c* as shown in FIG. 20B so that the styling operation is facilitated.

Figure 21A:
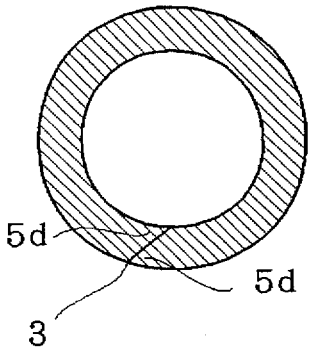
FIG. 21A is a cross sectional view of the core structure according to a fifth embodiment of this invention.

A fifth embodiment of the present invention is shown in FIG. 21.

Figure 21B:
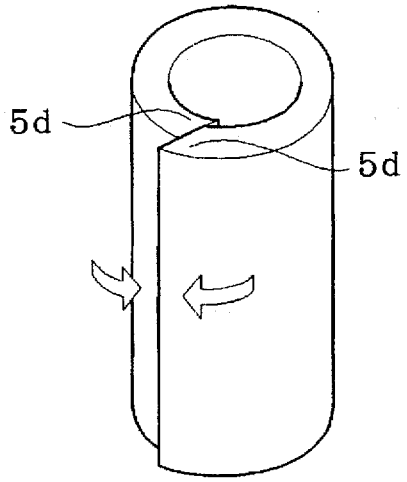
FIG. 21B shows a state of use thereof.

The cylinder according to this embodiment has the side portions 5 and 5, each of which is formed into an angular portion 5*d* seen in a cross section of the cylinder. The angular portions 5*d* and 5*d* are in a face contact with each other. Due to this construction, the cylinder can be diminished in its diameter only by clutching the cylinder by the hand of the user to shrink it, such that the inner angular portion is pressed into the inside of the cylinder due to the mutual slide of the angular portions as shown in FIG. 21B. Therefore, the core of this embodiment is further useful than that of the first embodiment, when it is used in such a diminished state.

Figure 22A:
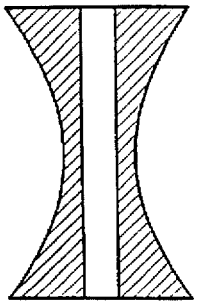
FIG. 22A and FIG. 22B are the vertical sectional views of the core structures according to other embodiments of this invention.
Figure 22B:
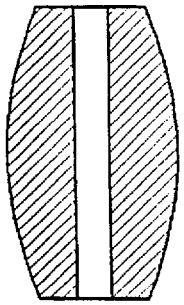
Figure 23A:
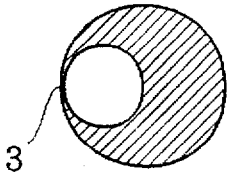
FIG. 23A to FIG. 23D are the cross sectional views of the core structures according to further embodiments of this invention.
Figure 23B:
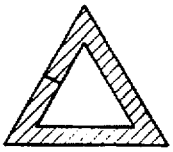
Figure 23C:
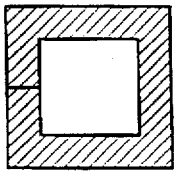
Figure 23D:
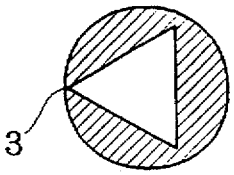
Figure 24A:
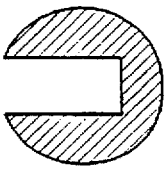
FIG. 24A and FIG. 24B are cross sectional views of non-cylindrical core structures.
Figure 24B:
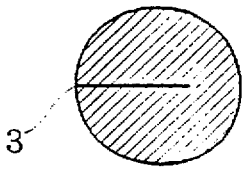

FIG. 22 and FIG. 23 show various types of modified embodiments of the present invention. FIG. 22A shows a cylinder having a constricted middle portion, and FIG. 22B shows a cylinder having a bulging middle portion. Also disclosed are a cylinder having an eccentric hole in FIG. 23A, a triangular cylinder in FIG. 23B, a square cylinder in FIG. 23C, and a circular cylinder having a triangular hole as seen in its sectional shape in FIG. 23D.

Here, the foregoing embodiments are just presented as the most preferable ones of the present invention and should not limit the scope of the claim of the invention.

What is claimed is:

1. A method of using a hair bundling core structure, which includes an elastic cylinder made of a foamed synthetic resin having a thickness and strength which are sufficient for facilitating a piercing of a hair setting U-shaped pin having pair of legs into and an extraction of the U-shaped pin from the elastic cylinder and for fixing hair to the elastic cylinder by the piercing of the U-shape pin, said elastic cylinder having a pair of end surfaces and is cut from one end surface to the other end surface to form a rift, said method comprising steps of:

setting hairs in a preset range of a head of a user into a first hair bundle having a root portion which is defined by a mass of root neighboring portions of the hairs, and binding a lower end of said first hair bundle in the root portion at a center of said preset range near roots of the hairs;

pinching the root portion at two sides of said center of the preset range with a pair of hairpins;

opening said rift to form a gap and inserting a lower portion of the root-bound, first hair bundle through the gap into a hole of the elastic cylinder to let the lower portion pass through the hole; pushing said core structure at its lower face onto an outer face of the head within said preset range; and fixing said core structure on the head of the user with said U-shaped pin by inserting one of the legs between said hairpins and a head skin, while said core structure is being pushed, and by piercing the other leg into a lower part of said core structure so that said core structure may be provided as a hair setting base.

* * * * *